United States Patent [19]

Ishinaga

[11] Patent Number: 4,812,062

[45] Date of Patent: Mar. 14, 1989

[54] PRINT HAMMER WITH FLUX DETECTION FOR PRINT PRESSURE CONTROL

[75] Inventor: Hiroyuki Ishinaga, Tokyo, Japan

[73] Assignee: Canon Kabushiki Kaisha, Tokyo, Japan

[21] Appl. No.: 127,173

[22] Filed: Dec. 1, 1987

[30] Foreign Application Priority Data

Dec. 12, 1986 [JP] Japan ..... 61-294735

[51] Int. Cl.[4] ..... B41J 9/38

[52] U.S. Cl. ..... 400/157.2; 400/124; 101/93.29; 361/190; 361/153

[58] Field of Search ..... 400/124, 157.2, 157.3, 400/166, 167; 101/93.02, 93.03, 93.05, 93.29; 361/152, 153, 159, 166, 168.1, 169.1, 187, 189, 190

[56] References Cited

U.S. PATENT DOCUMENTS

| | | | |
|---|---|---|---|
| 3,900,094 | 8/1975 | Larsen et al. | 197/1 R |
| 4,273,039 | 6/1981 | Luo et al. | 101/93.02 |
| 4,348,119 | 9/1982 | Carson, Jr. et al. | 101/93.02 |
| 4,473,311 | 9/1984 | Sakaida | 400/124 |
| 4,485,425 | 11/1984 | Grüner et al. | 361/153 |
| 4,667,117 | 5/1987 | Nebgen et al. | 400/157.3 |
| 4,744,684 | 5/1988 | Maekawa | 400/167 |

FOREIGN PATENT DOCUMENTS

| | | | |
|---|---|---|---|
| 179358 | 10/1984 | Japan | 400/157.2 |
| 172564 | 9/1985 | Japan | 400/157.2 |
| 149376 | 7/1986 | Japan | 400/157.3 |
| 49850 | 11/1986 | Japan | 400/157.2 |
| 252179 | 11/1986 | Japan | 400/157.2 |

*Primary Examiner*—David A. Wiecking

*Attorney, Agent, or Firm*—Fitzpatrick, Cella, Harper & Scinto

[57] ABSTRACT

A recording apparatus in which recording on a recording medium is perfomed by impacting against the recording medium. This recording apparatus has a recording unit which is constututed by a recording element supported so as to be reciprocatively movable relative to the recording medium, an electromagnet for generating a magnetic force which makes the recording element impact against the recording medium on the basis of a recording signal, a detection coil for detecting the magnetic flux generated by the electromagnet, and a controller for controlling, on the basis of the results of detection supplied from the detection coil, conditions under which the electromagnet is driven.

7 Claims, 5 Drawing Sheets

PRINT HAMMER WITH FLUX DETECTION FOR PRINT PRESSURE CONTROL

BACKGROUND OF THE INVENTION

1. Field of the Invention

This invention relates to a recording apparatus and, more particularly, to a type of recording apparatus that has an impact recording head which drives recording elements by using electromagnets.

2. Description of Prior Art

A known type of recording apparatus, such as a character printer or wire dot printer, performs recording in such a manner that recording elements are driven by solenoids so as to impact against a recording medium. In this type of apparatus, a solenoid coil is supplied with a driving current, and a recording element such as a wire or hammer is made to abruptly move forward and contact the recording medium. Switching elements such as transistors are used to drive the solenoid.

If it is necessary to accurately control and set the recording pressure to a desired intensity or to an intensity that accords with the types of character and recording medium, the driven state of the solenoid must be detected.

However, in a typical conventional apparatus, the solenoid coil cannot be controlled in the above described manner since coil drive conditions including the drive timing and the drive voltage and current are previously set within fixed ranges. In a rare type of apparatus, the drive current flowing through the coil is detected and the coil drive conditions are controlled in accordance with the value thereby detected. On the other hand, almost all impact recording heads of the electromagnetic drive type are controlled by open loops.

A method which involves measuring the magnetic flux of the coil, which is closely related to the attracting force generated by the solenoid, is one of the methods that are capable of controlling the recording pressure of the impact recording head most accurately. However, it is not possible for the above-mentioned types of conventional apparatus to perform accurate driving force control since they are based on an open-loop control method or a method of detecting the coil current.

In addition, in the case of solenoids used with the conventional impact heads, etc., residual magnetic flux is observed after driving due to eddy currents which occur in the core of the coil or to the hysteresis characteristics of the electromagnetic circuit. Therefore, there is a problem of delay in the advancing or returning movement of the armature due to such residual magnetic flux, or a problem of errors in the driving forces due to magnetic interference between the solenoids.

SUMMARY OF THE INVENTION

It is an object of the present invention to provide an impact type of recording apparatus capable of accurately controlling the recording pressure.

It is another object of the present invention to provide a recording apparatus which performs recording at a higher speed.

It is still another object of the present invention to provide a recording apparatus which is free of influence due to magnetic interference.

To attain these objects, the present invention provides a recording apparatus in which recording on a recording medium is performed by impacting against the recording medium, and which has: a recording element supported so as to be reciprocatively movable relative to the recording medium; electromagnetic force generating means for generating a magnetic force which makes the recording element project toward and impact against the recording medium in response to an applied recording signal; a detection means for detecting the magnetic flux existing at the electromagnetic force generating means; and a control means for controlling, in response to outputs from the detection means, the energization of the electromagnetic force generating means.

Other objects and features of the present invention will become clear upon reading the following descriptions.

DESCRIPTION OF THE PREFERRED EMBODIMENTS

Figure 2:
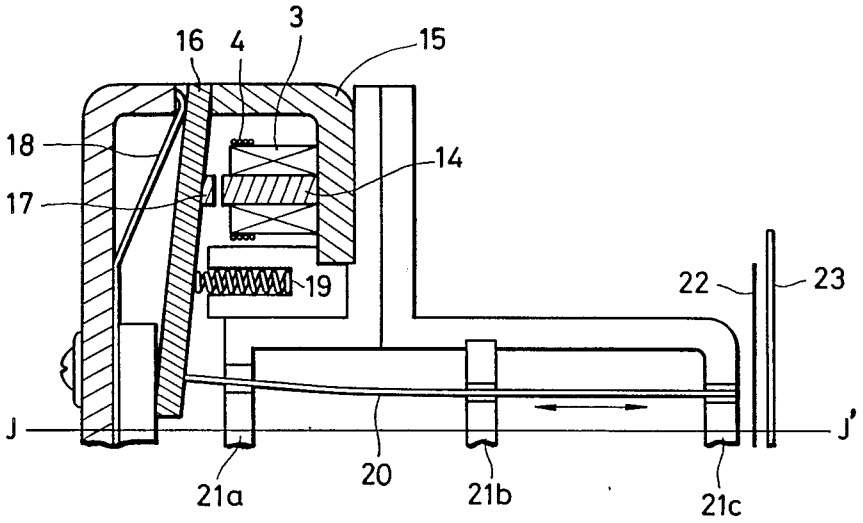
FIG. 2 is a cross-sectional view of the construction of a wire-dot head for which the circuit shown in FIG. 1 is used.

The present invention will be described in detail with respect to the preferred embodiments thereof in conjunction with the accompanying drawings. The embodiments described below relate to a wire-dot head. FIG. 2 is a cross-sectional view of the construction of a wire-dot head unit which has a recording wire 20 fixed to one end of an armature 16. The other end of the armature 16 is swingably supported by a retention spring 18. An iron piece 17 is attached to the armature 16 at a position in the vicinity of the support point at which the armature 16 is supported. The iron piece 17 is drawn by a core 14 of a solenoid coil 3 to the right as viewed in FIG. 2, that is, toward the front of the head. The core 14 of the solenoid coil 3 is connected to a yoke 15. The wire 20 is supported by a plurality of guides 21*a* to 21*c* disposed on the body of the head in such a manner that it can move reciprocatively in the directions indicated by the arrow in FIG. 2.

A plurality of units of this construction are arranged with respect to the center line J–J′ of the recording head, thereby constructing a wire-dot head capable of recording several dots simultaneously.

If, in the unit of the above construction, solenoid coil 3 is energized, the armature 16 is attracted to the right as viewed in FIG. 2, and the wire attached to the tip of the armature 16 advances and contacts a recording medium 23, such as paper, through an ink ribbon 22, thereby performing dot-recording.

The arrangement of these components is the same as the conventional arrangement, and the present invention adds to it a search coil 4 which is wound around the coil 3 and is adapted to detect the magnetic flux of the coil 3.

Next, a drive circuit for driving the above wire dot head unit will be described with reference to FIG. 1.

Figure 1:
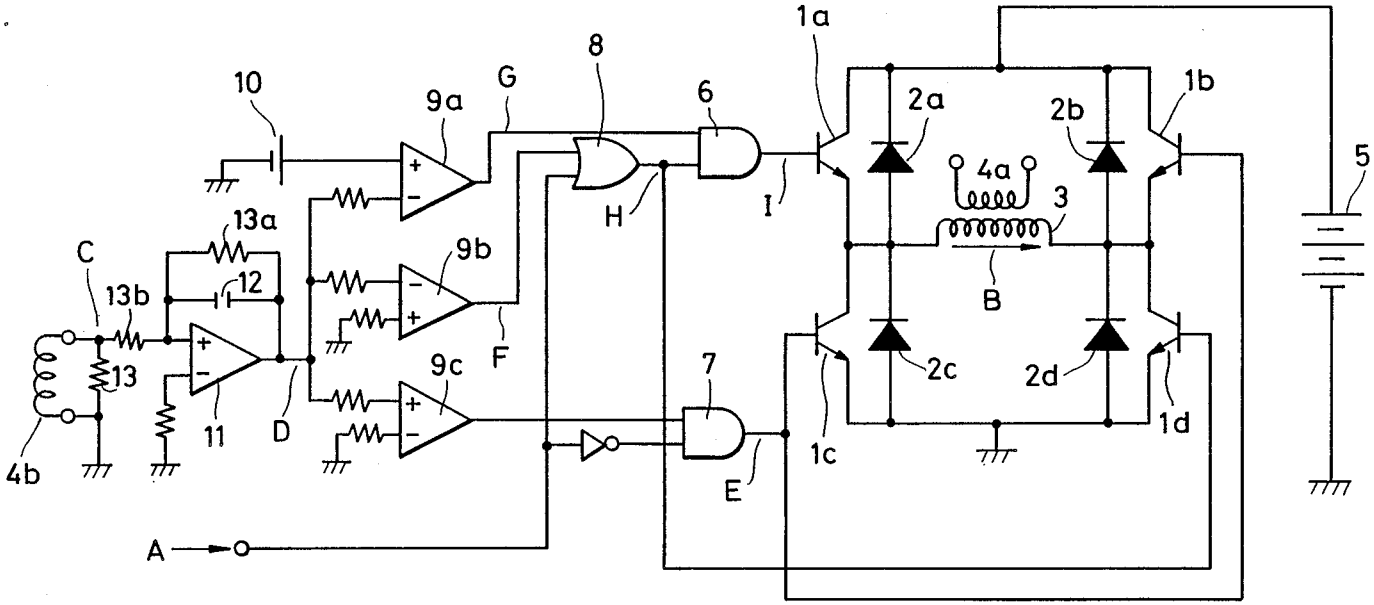
FIG. 1 is a circuit diagram of a drive circuit for driving a wire-dot head to which the present invention has been applied.

In FIG. 1, the above solenoid coil is indicated by the same reference numeral 3. The coil 3 is switched by a circuit which is different from an ordinary driving circuit and which consists of transistors 1*a* to 1*d* and diodes 2*a* to 2*d* and performs bipolar-direction driving. A reference numeral 5 denotes a driving power source of the coil 3.

A detection resistance 13 is connected in parallel to a winding 4*b* which constitutes the search coil 4. The winding 4*b* is wound concentrically with the solenoid coil 3 and, therefore, a change in the magnetic flux generating from the coil 3 is detected as a change in the voltage at the opposite ends of the resistance 13. The position at which the winding 4*b* is wound is indicated by a reference character 4*a* so as to make the position of the winding 4*b* clear.

The voltage at the opposite ends of the detection resistance 13 is input into an integration circuit constituted by an operational amplifier 11, an integration capacitance 12 and resistances 13*a* and 13*b*. The magnetic flux of the solenoid appears as the output from this integrator after being converted into a voltage.

Operational amplifiers 9*a* to 9*c* constitute a comparator. The operational amplifier 9*a* compares the output from the integrator with a reference voltage 10 and controls the transistor 1*a* so as to stabilize the integrator output. The output from the operational amplifier 9*a* is input into the transistor 1*a* via an AND gate 6.

The operational amplifiers 9*b* and 9*c* are polarity-detection circuits which output high level signals. The operational amplifier 9*b* outputs a high level when the output from the integrator becomes negative, and the operational amplifier 9*c* outputs a high level when the output of the integrator become positive. These polarity detection circuits control the switching transistors so as to erase the magnetic flux of the solenoid. The output from the operational amplifier 9*b* is introduced via an OR gate 8 to the transistor 1*d* and to the other input of the AND gate 6 and is input into the transistor 1*a* through the AND gate 6. The output from the operational amplifier 9*c* is input into the transistors 1*b* and 1*c* through an AND gate 7.

A signal A, which is input into the OR gate 8 and, after being inverted, into the AND gate 7, is a fundamental drive signal which provides drive timing.

Each of the solenoids disposed in the recording head is constructed in the above-described manner.

The operation of the thus arranged circuit will be described in detail with reference to FIG. 3 which shows voltage or current waveforms at connection points indicated by corresponding reference characters A to I in FIG. 1.

The operations of the operational amplifiers 9*a* to 9*c* will be described first. The operational amplifier 9*a* compares a voltage value D, which is obtained by integrating a voltage C across the winding 4*b* of the search coil 4, and the reference voltage 10 with each other. The operational amplifier 9*a* outputs a high level if the integrated value D is lower than the reference voltage 10 and a low level if the integrated value D is higher than the reference voltage 10.

The operational amplifier 9*b* compares the integrated value D with a voltage slightly lower than the zero potential; and it outputs a high level if the integrated value D is lower than this voltage and a low level if the integrated value D is higher than this voltage.

Conversely, the operational amplifier 9*c* compares the integrated value D with a voltage slightly higher than the zero potential; and it outputs a high level if the integrated value D is higher than this voltage and a low level if the integrated value D is lower than this voltage.

Figure 3:
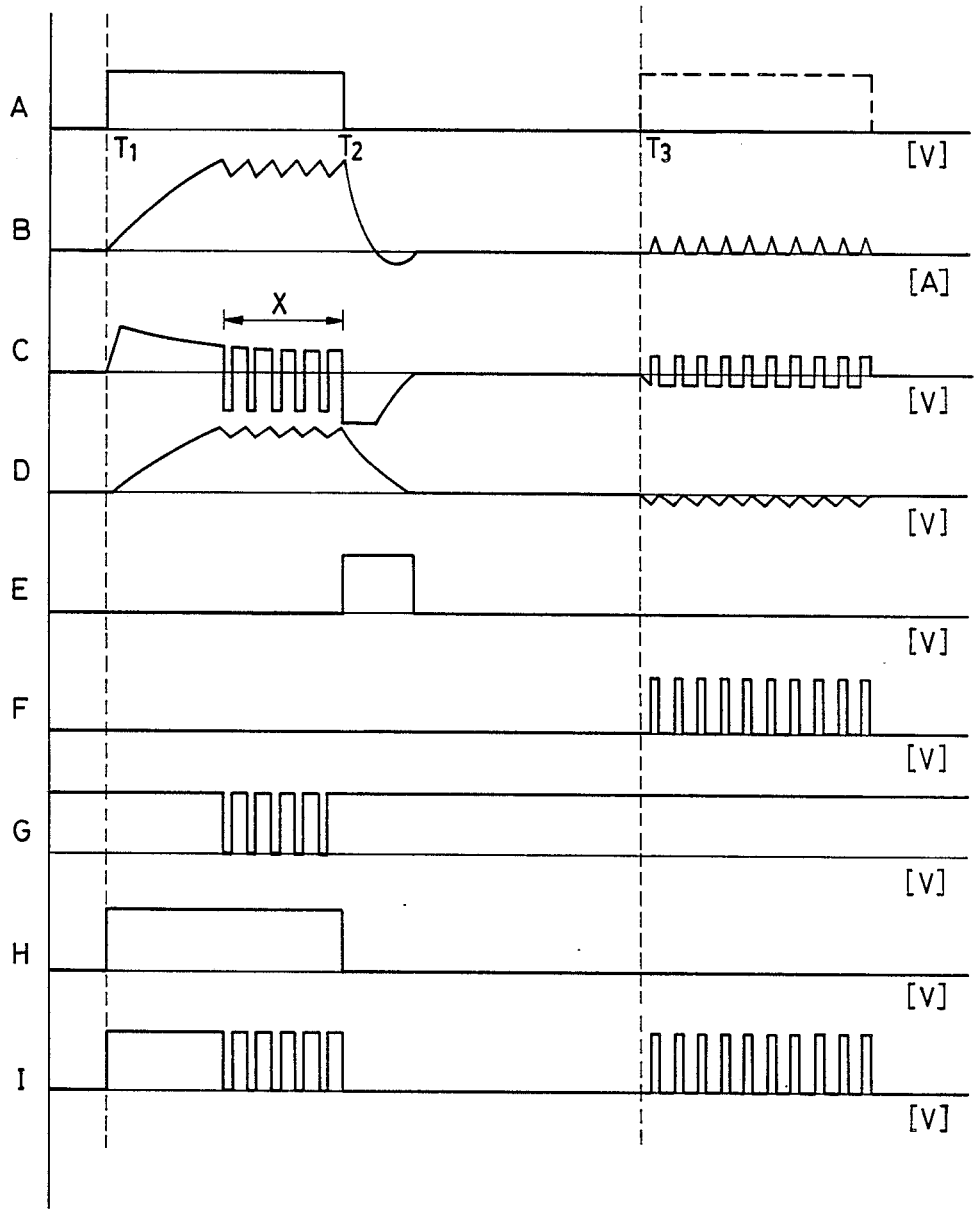
FIG. 3 is a waveform diagram of the operation of the circuit shown in FIG. 1.

If the fundamental drive signal A is input at a time $T_1$ shown in FIG. 3, the transistors 1*a* and 1*d* are thereby switched through the OR gate 8 and the AND gate 6 since the output of the operational amplifier 9*a* is high, so that a current flows through the coil 3 in the direction indicated by the arrow B in FIG. 1.

At this time, an electromotive force, such as that indicated by the reference character C, occurs across the winding 4*b*, so that the integrated value D increases gradually. When this value exceeds the reference voltage 10, the output G of the operational amplifier 9*a* becomes low, thereby starting intermittent control in which the transistors 1*a* and 1*d* are switched off so as to make the magnetic flux regular, as indicated by a reference character X in FIG. 3.

When the fundamental drive signal A thereafter dies off, the transistors 1*b* and 1*c* are switched on and the transistors 1*a* and 1*d* are switched off since the output of the operational amplifier 9*c* is high. That is, the drive polarity of the coil 3 is inverted in order to rapidly erase the residual magnetic flux.

The magnetic flux of the solenoid abruptly decreases by this drive polarity inversion. Even after the coil current has exceeded zero, a current flows by the residual magnetic flux of the solenoid in the direction opposite to that indicated by the arrow B in FIG. 1, thereby completely erasing the magnetic flux.

If the solenoid is driven in this manner, the residual magnetic flux can be erased more rapidly compared with the conventional methods, and it is then possible to perform the next driving operation in a short interval without being influenced by the residual magnetic flux. Thereby the recording speed is increased.

Next, the operation in accordance with the present invention will be described below with respect to the case in which the solenoid undergoes magnetic interference when an adjacent solenoid disposed in the head is driven by the timing indicated by the reference character $T_3$ in FIG. 3.

If the coil 3 is assumed to undergo interference such as that which makes the integrated value D a negative voltage, intermittent control is performed in such a manner that the output F of the operational amplifier 9*b* becomes high, the transistors 1*a* and 1*d* are switched on, and the integrated value D approaches zero. In the case of magnetic interference in the opposite direction, intermittent control is performed by the operational amplifier in the same manner.

The residual flux after driving the solenoid in the recording head is thus erased rapidly. It is thereby possible to greatly increase the recording speed and achieve accurate driving force control by completely eliminating magnetic interference between the solenoids even if a plurality of solenoids are disposed in the recording head. The solenoids need not be spaced apart from each other in order to avoid magnetic interference. It is therefore possible to reduce the overall size of the head.

The above embodiment exemplifies an arrangement in which the magnetic flux of the coil is controlled so as to be constant. Otherwise, the driving force may be controlled as desired by controlling the reference voltage for the operational amplifier 9*a*.

Figure 4:
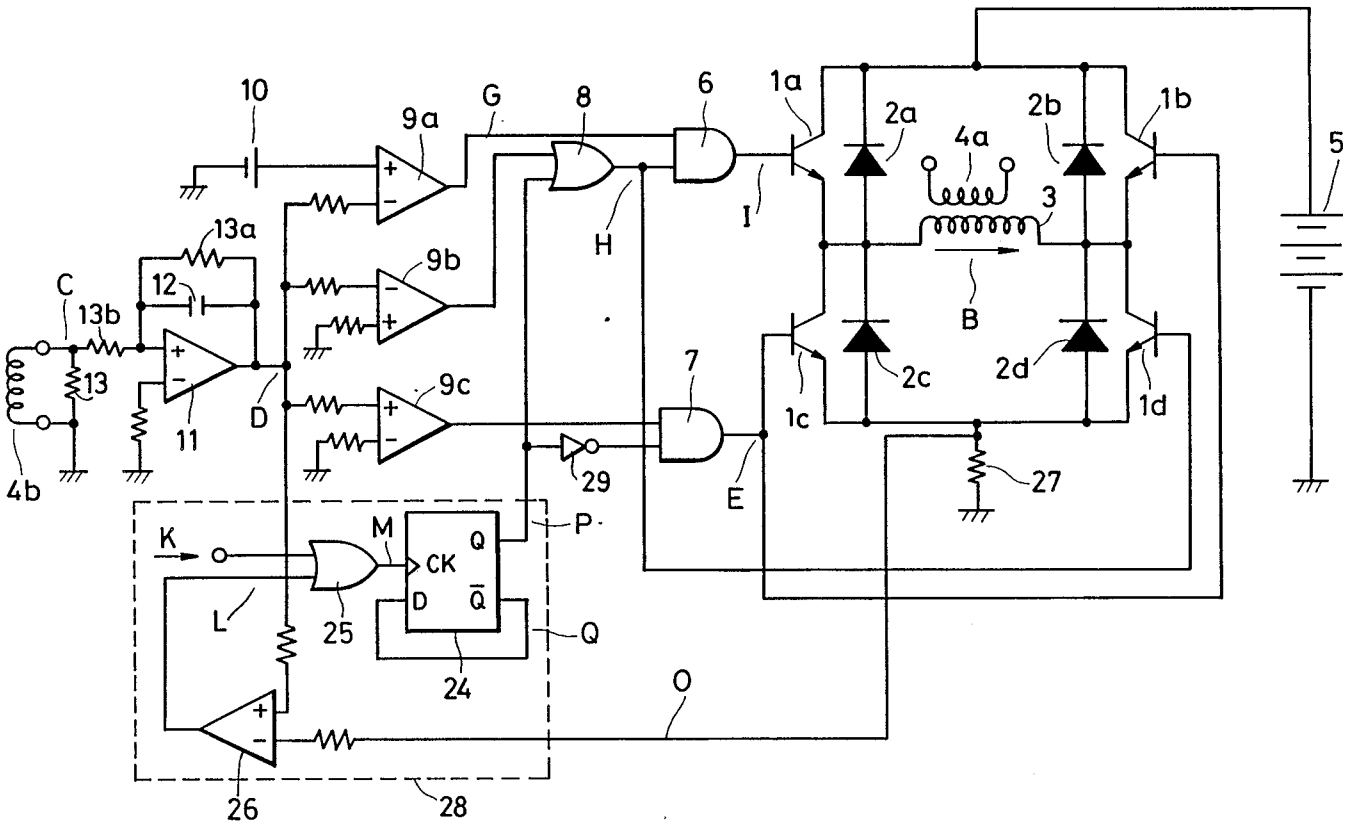
FIG. 4 is a circuit diagram of a modified example of the circuit shown in FIG. 1.
Figure 5:
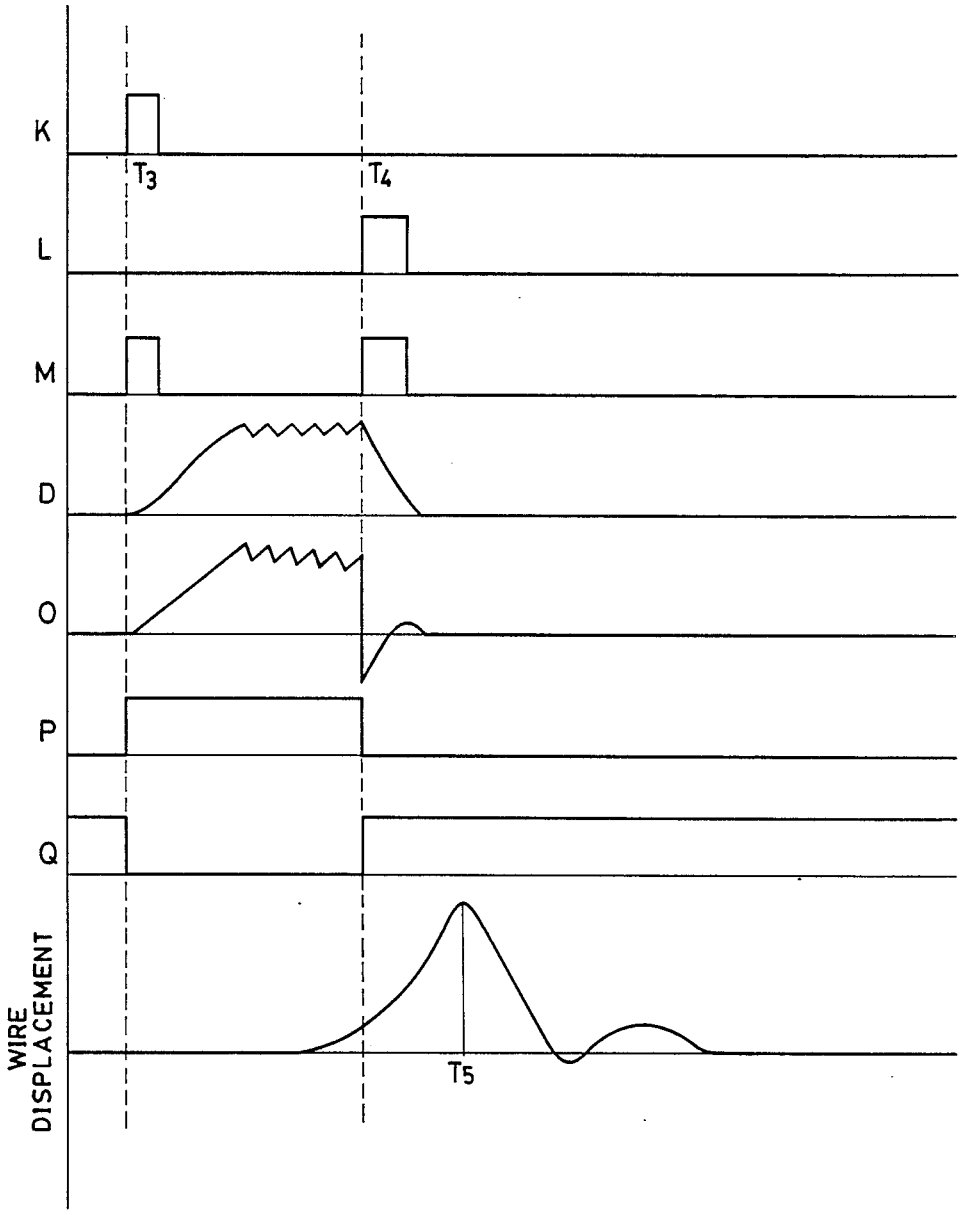
FIG. 5 is a waveform diagram of the operation of the circuit shown in FIG. 4.

FIGS. 4 and 5 show another embodiment of the present invention. The arrangement shown in FIG. 4 is obtained by adding a current detecting resistance 27 and a block 28 encircled by a broken line to the circuit shown in FIG. 1. One end of the current detecting resistance 27 is connected to the emitter connection point between the transistors 1*c* and 1*d*, and the other end is connected to ground. Accordingly, the terminal voltage of the detection resistance 27 corresponds to the current that flows from the power source 5 to ground via the coil 3.

The voltage detected by the resistance 27 is input into the minus (−) terminal of an operational amplifier 26 in the circuitry encircled by the broken line. The plus (+) terminal of the operational amplifier 2*b* is supplied with the integrated value D from the operational amplifier 11. The output from the operational amplifier 26 is input into an OR gate 25, and the output from the OR gate 25 is input as a clock into a flip flop 24. The data input terminal of the flip flop 24 is connected to the inverting output terminal $\overline{Q}$ thereof.

The output Q from the flip flop 24 is input into the OR gate 8 and to an inverter 29 in front of the AND gate 7 in place of the fundamental drive signal A used in the arrangement off FIG. 1. A fundamental signal K for supplying drive signal timing is input into the other input terminal of the OR gate 25. This fundamental signal acts to set the time at which the driving operation starts. The driving period is determined by the D flip flop 24.

The operational amplifier 26, which functions as a comparator, compares a voltage value O converted from the coil current by the detection resistance 27 with the integrated value D that corresponds to the magnetic flux of the solenoid. The operational amplifier 26 thereafter outputs a high level when the value O exceeds D by an amount equal to or greater than a desired set value. The flip flop 24 proceeds in a stepping manner by a signal which represents the logical add of the fundamental pulse K which drives the solenoid and the output L from the operational amplifier 26; and the flip flop 24 is inverted to a high level output by the first pulse and to a low level output by the second pulse.

Referring to FIG. 5, when the drive timing pulse K is input at the time $T_3$, and the flip flop 24 is inverted from a low level to a high level output through the OR gate 26.

The coil 3 thereby starts to be energized and is controlled in such a manner that the magnetic flux of the coil becomes regular on the basis of the integrated value D in the same manner as described above. Therefore, the drive current detection value O gradually increases at an initial stage of driving but it starts to fall after it has reached a certain level. This is because the gap between the core 14 and the iron piece 17 shown in FIG. 2 becomes narrower than the wire displacement shown in FIG. 5 so that the magnetic reluctance of the magnetic circuit is reduced. When the current detection value O becomes smaller than the value of the other input of the operational amplifier 26 that corresponds to the integrated value, the flip flop 24 is inverted through the OR gate 25, and the supply of power to the coil 3 is cut off.

This driving method enables the following advantages.

The coil 3 is energized in the above-described manner, the wire 20 driven by the solenoid is displaced as indicated in the lowermost section in FIG. 5. The reference character $T_5$ indicates the time at which the wire contacts the recording medium 23 through the ink ribbon 22. In particular, if the driving magnetic flux remains after this time, the operation of returning the wire is obstructed and, hence, high-speed operation is impeded.

However, in accordance with the above-described control, the supply of power to the coil is cut off immediately after a desired magnetic flux density has been obtained, thereby eliminating any obstruction to the operation of returning the wire, and enabling speedup of the operation. In addition, the electric power needed to drive the head can be minimized, thereby reducing the power consumption.

The present invention has been described with respect to an embodiment for use in a wire-dot printer or specifically with respect to the wire-dot head having an attraction type of solenoid, but the same technique can be also applied to a head of a spring-charge type. Also, the present invention is not limited to a wire dot head and the same technique can be applied to a head for use in a character impact printer.

In the above-described embodiment, the search coil is used as a means for detecting the magnetic flux of the solenoid coil, but other means such as hall elements can be used instead.

In accordance with the present invention, as is clear from the foregoing, a recording apparatus having an impact recording head in which a recording element is driven by an electromagnet is provided with a means for detecting the magnetic flux generated by the electromagnet, and a means for controlling, on the basis of detected values supplied from the detection means, the conditions under which the electromagnet is controlled. The improved apparatus thus constructed can accurately drive the recording head under desired drive conditions.

What is claimed is:

1. A recording apparatus of impact type with print pressure control, said recording apparatus comprising:

a recording element supported so as to be reciprocatively movable relative to the recording medium;

electromagnetic force generating means for generating a magnetic force which makes said recording element project toward and impact against said recording medium in response to an applied energizing signal of a predetermined polarity;

detection means for detecting the magnetic flux existing at said electromagnetic force generating means; and control means for controlling, in response to outputs from said detection means, said energizing signal and for reversing the polarity thereof when a detected output from said detection means reaches a predetermined value, so as to excite a magnetic field in a direction to erase the residual magnetic flux.

2. A recording apparatus according to claim 1, wherein said detection means includes a coil disposed close to said electromagnet.

3. A recording apparatus according to claim 1, wherein said control means includes a plurality of switching elements for switching the direction of said energizing signal.

4. A recording apparatus according to claim 1, wherein said control means includes a constant voltage circuit for regulating a voltage applied to said electromagnetic force generating means.

5. A recording apparatus according to claim 1, wherein said recording element, electromagnetic force generating means and detection means comprise a first recording unit which is arranged proximate to other recording units, each of which comprises a recording element, an electromagnetic force generating means and detection means, with all of said recording units comprising a recording head.

6. A recording apparatus of impact type, with print pressure control, said recording apparatus comprising:

a recording element supported so as to be reciprocatively movable relative to the recording medium;

electromagnetic force generating means for generating a magnetic force which makes said recording element project toward and impact against said recording medium in response to an applied recording signal;

detection means for detecting the magnetic flux existing at said electromagnetic force generating means; and control means for controlling, in response to outputs from said detection means, the energization of said electromagnetic force generating means, wherein said electromagnetic force generating means includes an electromagnet, and wherein said control means includes comparing means for comparing a first value, corresponding to energizing current flowing through said electromagnet, and a second value, corresponding to the results of detection from said detection means, and wherein said control means is arranged to switch the direction of said energizing current flowing through said electromagnet in response to outputs from said comparing means.

7. A recording apparatus according to claim 6, wherein said control means includes a plurality of switching elements connected and arranged to switch the direction of energizing current in said electromagnet in response to the rise of said recording signal, and thereafter to switch the direction of said energizing current flowing through said electromagnet in response to an output of said comparing means to rapidly demagnetize said electromagnet.

* * * * *